US005114095A

United States Patent [19]

Schroppel et al.

[11] Patent Number: 5,114,095

[45] Date of Patent: May 19, 1992

[54] ARRANGEMENT FOR THE UNLATCHING AND EXTENSION OF THE STABILIZING FINS OF A PROJECTILE

[75] Inventors: Werner Schroppel, Wendelstein; Thomas Leidenberger, Nurnberg, both of Fed. Rep. of Germany

[73] Assignee: Diehl GmbH & Co., Nuremberg, Fed. Rep. of Germany

[21] Appl. No.: 717,688

[22] Filed: Jun. 19, 1991

[30] Foreign Application Priority Data

Jun. 30, 1990 [DE] Fed. Rep. of Germany ..... 4020897

[51] Int. Cl.[5] ..... F42B 10/20

[52] U.S. Cl. ..... 244/3.28

[58] Field of Search ..... 244/3.28, 3.3

[56] References Cited

U.S. PATENT DOCUMENTS

| | | | |
|---|---|---|---|
| 2,801,587 | 8/1957 | Gould | 244/3.3 |
| 4,600,167 | 7/1986 | Kastenhuber et al. | 244/3.28 |
| 4,659,037 | 4/1987 | Unterstein | 244/3.28 |
| 4,860,969 | 8/1989 | Muller et al. | 244/3.28 |

FOREIGN PATENT DOCUMENTS

| | | | |
|---|---|---|---|
| 1152013 | 2/1958 | France . | |
| 1273342 | 8/1961 | France | 244/3.28 |
| 1513277 | 1/1968 | France | 244/3.28 |
| 634090 | 3/1950 | United Kingdom . | |
| 0977111 | 12/1964 | United Kingdom | 244/3.28 |

*Primary Examiner*—Michael J. Carone

*Attorney, Agent, or Firm*—Scully, Scott, Murphy & Presser

[57] ABSTRACT

An arrangement for the unlatching and extension of the stabilizing fins or control surfaces of a projectile, including a power element which is effective in the longitudinal direction of the projectile for pressing a follower against camming or runoff edges located proximate hinged connections at the fin footings, after a latching for the stabilizing fin in the region of their end surfaces has been released. The power element causes a latching crown or ring to be raised away from the end surfaces of the stabilizing fins opposite the force of a spring through the longitudinal movement of a connecting or pusher rod prior to the pusher rod engaging behind the follower and then pressing against the runoff or camming edges.

15 Claims, 5 Drawing Sheets

ARRANGEMENT FOR THE UNLATCHING AND EXTENSION OF THE STABILIZING FINS OF A PROJECTILE

BACKGROUND OF THE INVENTION

1. Field of the Invention

The present invention relates to an arrangement for the unlatching and extension of the stabilizing fins or control surfaces of a projectile, including a power element which is effective in the longitudinal direction of the projectile for pressing a follower against camming or runoff edges located proximate hinged connections at the fin footings, after a latching for the stabilizing fin in the region of their end surfaces has been released.

2. Discussion of the Prior Art

An arrangement of that type has become known from the disclosure of U.S. Pat. No. 2,801,587 for a missile or rocket which is launched from a launcher tube. The fins which are retracted rearwardly of the rocket propulsion mechanism are retained together through the intermediary of a wire which is sheared for the triggering of the propulsion mechanism. As a result of the gas pressure which is present in the propulsion mechanism, a piston with a support disc is then pressed against runoff or camming edges on the stabilizing fins which are oriented transverse to the piston movement, in order to impart these a torque about pivot axes which are located radially outwardly of the contacting region. As long as the rocket still has not as yet egressed from the launcher tube, the outward pivoting movement of the stabilizing fins is in all instances restricted by the internal mantle or casing surface of the tube. After exiting from the muzzle of the tube, the stabilizing fins can then pivot outwardly and in the final end position of movement, the support disc is then located radially between the stabilizing fins in order to block any kind of retrograde movement. Such a release and activation in the outward pivoting movement of stabilizing fins is, in any case, not employable when the deployment of the projectile which is utilized in air or in water is not effectuated through the intermediary of a launcher tube, but through delivery from a carrier at a high rate of speed. This is, because in such instance, the release of the initially blocked stabilizing fins can only be implemented immediately prior to the initiation of their outward pivoting movement, in order to avoid causing any damages or also even only operative malfunctions due to a premature, too slow or non-uniformly outwardly pivoting of the fins during the delivery from the carrier. For such a case of deployment, the simple latching crown pursuant to German Patent 37 21 512 which already unlatches in response to the starting acceleration, is also not applicable herein.

In accordance with the disclosure of French Patent 1 152 013, the supporting disc which is displaceable through the action of a piston and which is employed for the outward extension of the stabilizing fins serves concurrently for arresting the fins in their retracted position; however, which may be subject to operational malfunctions when the extending movement which is interrelated with the release of the latching is disturbed by any kind of inexpedient environmental influences. Moreover, there cannot be attained the necessary moments for the secure retention of the stabilizing fins in their retracted position and for the most rapidly possible outward extension when, in this instance, both functions are to be carried out in close proximity to the pivoting axes for the fins. In contrast, a spindle or worm drive for the irreversible fin movement pursuant to British Patent 634 090 is much too slowly operating with respect to the extremely rapid and specified extending movement for the stabilizing fins which, in particular, is necessary during the delivery of submunition-projectiles in supersonic flight for a stable transition into the free-flight phase.

Also the inflation of a support volume or device for the extension of the stabilizing fins, such as is known from the disclosure of German Laid-Open Patent Appln. 34 32 614, necessitates an excessively lengthy operational period of time in comparison with the period of time which is required for stabilization, when the projectile is expelled somewhat axially-parallel, laterally from a dispenser at a multiple of supersonic speed. Moreover, such an inflatable support device necessitates the provision of an excessively large installation volume, as a result of which the payload ratio, especially that of a submunition projectile, is adversely influenced to an unacceptable extent.

In addition thereto, it is possible that such types of projectiles will in all instances possess a slight spin upon expulsion from their dispenser, such that no mentionable centrifugal forces stand available for supporting the outward extending movement of the stabilizing fins from their retracted deploying position. In order to be able to ensure the flight dynamic stabilizing immediately subsequent to the release from the carrier, it is, however, necessary that the stabilizing fins not only be extended already during the expulsion movement but as soon as possible thereafter, and then within the shortest possible timespan into the operative position in which they extend away from the outer casing surface.

SUMMARY OF THE INVENTION

Accordingly, it is an object of the present invention to provide an arrangement of the type as considered herein which, with regard to a specifiable operational point in time, especially in dependence upon the expulsion from a dispenser, and at a small-constructed physical implementation there is facilitated an operationally reliable procedure in the unlatching of the stabilizing fins and taking place immediately thereafter, an extremely rapid outwardly extending movement of the stabilizing fins.

The foregoing object is inventively achieved in that the inventive arrangement as described herein has the power element causing a latching crown or ring to be raised away from the end surfaces of the stabilizing fins opposite the force of a spring through the longitudinal movement of a connecting or pusher rod prior to the pusher rod engaging behind the follower and then pressing against the runoff or camming edges.

In accordance with the foregoing object there is provided a separately activatable power element which can forcibly initiate the outwardly extending movement of the stabilizing surfaces only subsequent to having released the latching engagement of the stabilizing fins in their retracted deploying position. For this purpose, a pusher or connecting rod extends between the retracted stabilizing fins from the foot of the fin towards the free edge of the distal fin end surface, which rod is displaceable axially-parallel by the power element, and wherein the end of the rod which is distant from the power element is equipped with a latching crown or ring, such as is known in the technology per se. Only then, when the rod has been displaced to such an extent that the latching crown has released its form-fitted engagement into the end surface edges of the stabilizing fins, does the opposite end contact a shoulder or flange with a follower which is displaceable on the rod such that, upon a further displacement of the rod, the follower will press against the stabilizing fins in proximity with the articulating linkage present at the footing of the fins. Consequently, this will ensure that the extending movement can only first be initiated when it has been released from its latching engagement; and this staggering in time of the two functions allows these to be presently implemented with minimal requirements in energy. Moreover, just as well as the unlatching, there is also effectuated the imposition of torques simultaneously on all stabilizing fins for the outward extension of the fins into their operative positions within a specified sequence in time after the release of the latching at the end surfaces of the fins.

The pusher rod which, at one end thereof is fixedly equipped with the latching crown and at the opposite end loosely equipped with the follower, can be provided constructed small in size and of light weight, as well as a preassembled and tested operational component, such that low manufacturing costs unite themselves with a high operational reliability at an optimal utilization of space in the interest of obtaining a good payload ratio.

Between the crown of the latching device and a neighboring part which is fixed to the structure of the projectile, there is also positioned a spring element which counteracts against the power element of the drive arrangement for the pusher rod, so as to be able to manually unlatch the stabilizing fins; for instance, for testing purposes, through a raising away of the pusher rod from the power element; in essence, not having to activate the power element for the unlatching action. Through the employment of a helical compression spring which narrows in a frusto-conical configuration, there is achieved the advantage of a minimal blocking length.

Through a wedge-shaped section for the casing surface and the applicable formation of the recess at the end surface of the associated stabilizing fin, there is obtained the advantage of an engagement of the latching crown into the associated recess in the absence of any play or looseness so that upon any encountered vibrations of the airborne body, the force-transmissive and form-fitted close connection between the latching crown and the stabilizing fins in the inoperative or inactive position of the airborne body or, respectively, its stabilizing fins will remain intact.

In order to be able to maintain maximum loads and stress peaks in the star-shaped leaf spring and/or at the camming or runoff edge of each stabilizing fin during the extending movement of the stabilizing fins as low as possible, it is advantageous when spring or resilient strips of a star-shaped leaf spring of the follower arrangement, in the inoperative position of the stabilizing fins, act with a concavely curved partial section against the applicable camming edge of the associated stabilizing fin.

In a guidable projectile or missile, in the inoperative position of the stabilizing fins, every resilient strip of the leaf spring can have the end section which is distant from the central portion extend into an associated recess formed in the shaft of the corresponding stabilizing fin. By means of a single drive device, there are then carried out the functions in the eliminating of the latching of the individual fin shafts, the release of the stabilizing fins and the extension or, in essence, the unfolding of the stabilizing fins. In particular, in this manner it is also possible to obviate the need for electromechanical brakes for the arresting of the stabilizing fin shafts, as has been done for a long time until the present, so that this last-mentioned construction also appears to be inventive per se.

The pusher rod can be so configured in its cross-section that it will prevent any undesirable transverse or cross-current airflow through the slits for the fins and the structure in the projectile. As a result thereof, the aerodynamic coefficient of buoyancy lift will not be negatively influenced.

BRIEF DESCRIPTION OF THE DRAWINGS

Reference may now be had to the following detailed description of an exemplary embodiment of the inventive projectile or missile with guidable stabilizing fins, from which there may be ascertained further inventive details, features and advantages, taken in conjunction with the accompanying drawings; in which.

DETAILED DESCRIPTION

Figure 1:
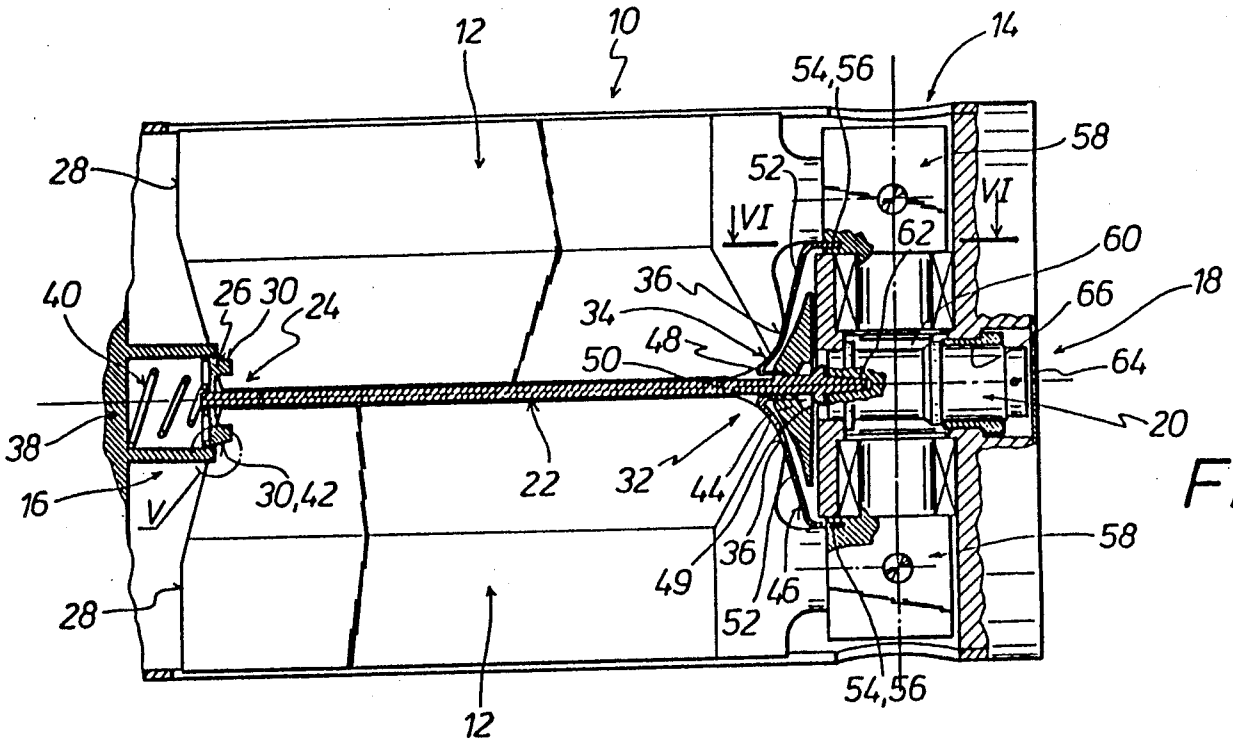
FIG. 1 illustrates a partly longitudinally sectioned view of a partially shown projectile in its inoperative position, in which the stabilizing fins are retracted and latched in place.
Figure 3:
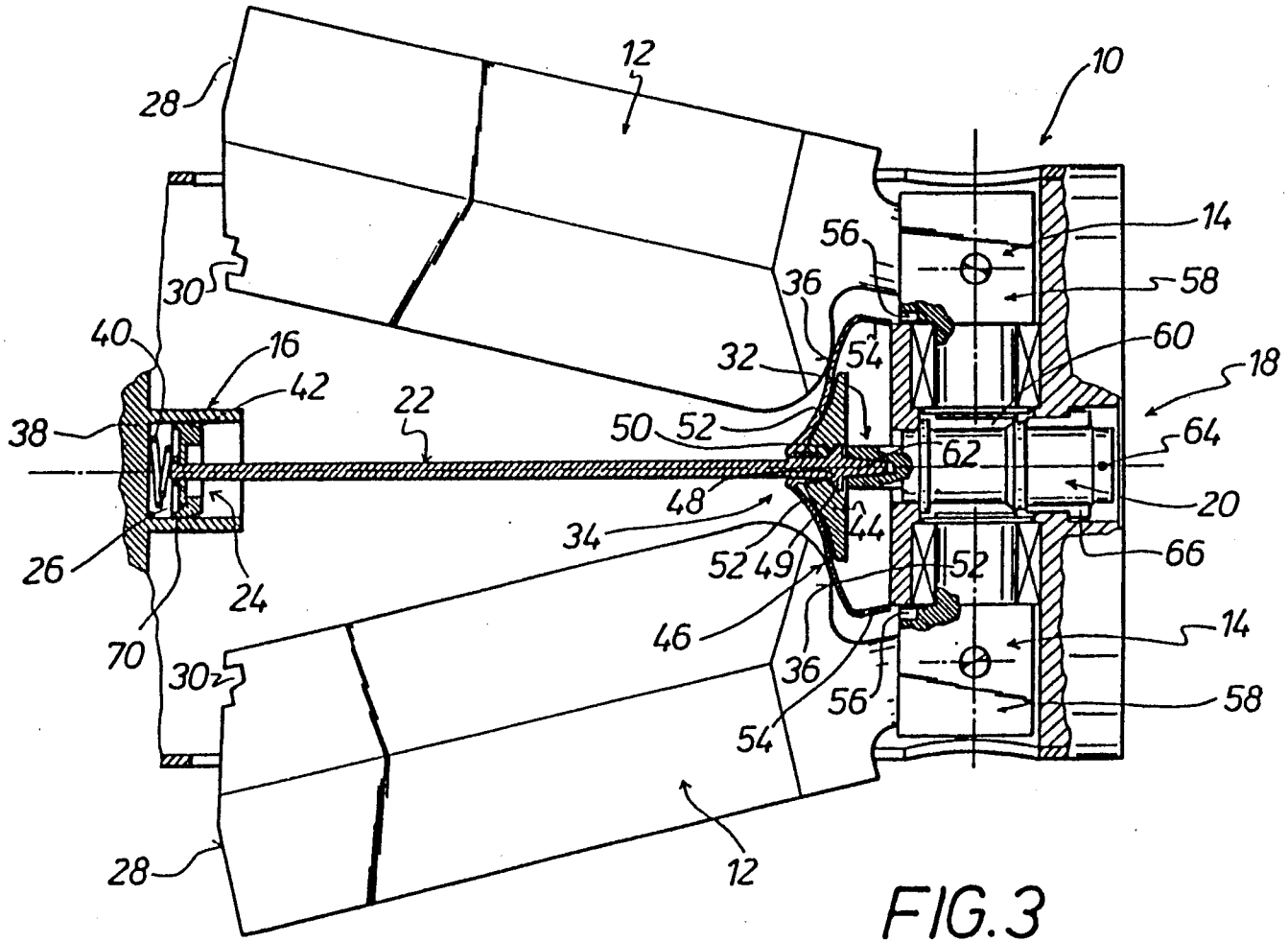
FIG. 3 illustrates a second interim position of the projectile in which the extending procedure for the stabilizing fins has been initiated, and the fin shafts which are associated with the stabilizing fins have been unlatched.
Figure 4:
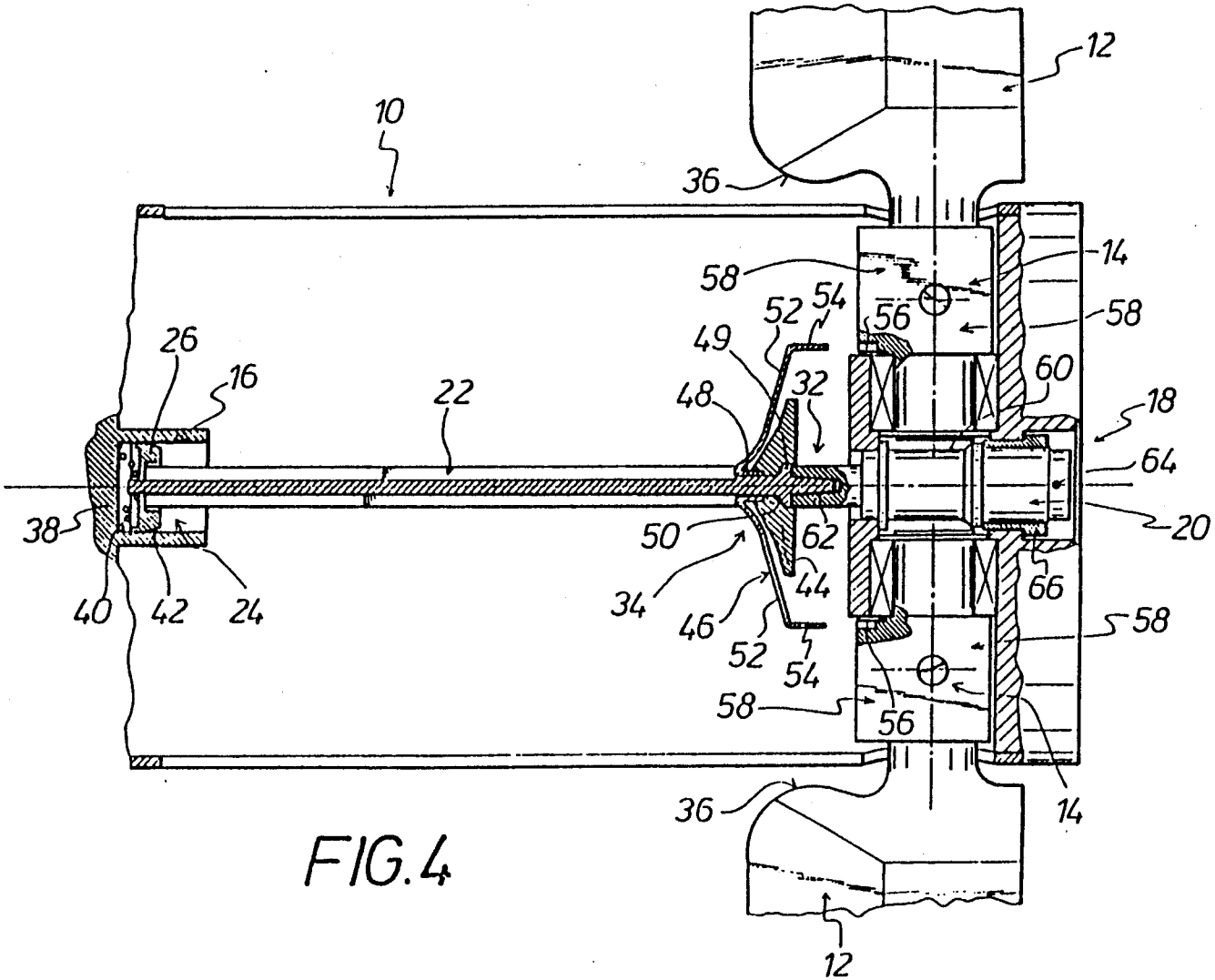
FIG. 4 illustrates a representation of the projectile in the position of flight, similar to FIGS. 1 to 3, in which the partially shown stabilizing fins extend away from the projectile and the fin shafts which are associated with the stabilizing fins are freely rotatable for effecting the guidance of the projectile.

Referring now in specific detail to the drawings, FIG. 1 illustrates the trailing end portion of a projectile 10, which possesses stabilizing fins 12 which are adjustable between an inoperative position shown in FIG. 1 and a flying position as indicated in FIG. 4. Each stabilizing fin 12 is supported on an associated bearing device 14 so as to be pivotable between the inoperative position and the extended flying position. A latching device 16 is provided for the purpose of retaining the stabilizing fins 12, in the inoperative position of the projectile 10, retracted in a space-saving manner within the projectile 10. A driving device 18 serves to extend the stabilizing fins 10 from the inoperative position indicated in FIG. 1 into the position of flight in which they extend away from the projectile 10. The drive device 18 possesses a power element 20 which; for instance, may pertain to a pyrotechnic power element which is operatively connected with a pusher or actuating rod 22. As can be ascertained from FIG. 1, the pusher rod 22 is located in the central region intermediate the stabilizing fins 12 which are each retracted into their inoperative position. The pusher rod 22 is displaceable along its longitudinal direction by means of the power element 20, as can be further ascertained by reference to FIGS. 2 through 4 and the description in the specification relative thereto. At the forward or leading end section 24 of the pusher rod 22 which is remote from the power element 20, there is provided a latching crown or ring 26 of the latching device 16. The stabilizing fins 12 each possess a recess 30 at their end surfaces 28 which are remote from the associated bearing device 14, into which recess there engages the latching crown 26 of the latching device 16 in the inoperative position of the projectile 10, having reference to FIG. 1, in order to securely restrain the stabilizing fins 12 in their inoperative position in a form-fitting and positive manner until an activation of the power element 20 of the drive device 18.

On the rearward end section 32 of the pusher rod 22 towards the power element 20 there is provided a follower device 34 which is constructed so as to be freely movable within a limited amount relative to the pusher rod 22. The follower device 34 is arranged in proximity to a camming or runoff edge 36 on each stabilizing fin 12 bounding the applicable bearing device 14.

Arranged between the latching crown 26 of the latching device 16 and partially illustrated fixed section 38 on the airborne body 10, is a spring element 40 which acts opposite the power element 20 of the driving device 18 for the pusher rod 22. The spring element 40, in the exemplary embodiment shown in FIG. 1, is a helical compression spring, which is constructed so as to narrow frusto-conically.

Figure 5:
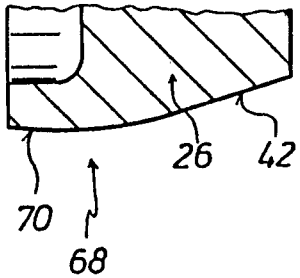
FIG. 5 illustrates, on an enlarged scale, the encircled detail V shown in FIG. 1.

As can also be clearly seen from FIG. 5, the latching crown 26 possesses a wedge-shaped mantle surface section 42 which is constructed so as to narrow in the direction from the leading end towards the tail end of the projectile 10. The recess 30 which is formed in the end surface 28 of each stabilizing fin 12, is constructed with a profiling which conforms with the cross-sectional profile of the latching crown 26 or; in essence, the wedge-shaped casing surface sections 42, as can be clearly seen; for example, from FIGS. 2 and 3. At its end section 68 which is remote from the driving device 18, the latching crown 26 possesses a cambered outer casing surface 70. Due to the cambered outer casing surface 70, there is assuredly precluded the possible tipping of the latching crown which is caused by the short guide length which is present, so as to eliminate problems caused by the elastic deformation of the entire projectile.

The follower device 34 which is located at the rearward end section 32 of the pusher rod 22 in proximity with the power element 20 of the driving device 18, and which becomes effective on the camming or runoff edge 36 of each stabilizing fin 12, possesses a central portion 44 and a star-shaped leaf spring 46. The star-shaped leaf spring 46 is formed with a central collar 48, by means of which the star-shaped leaf spring 46 is mechanically fixedly connected with the central portion 44. The pusher rod 22 is freely movable within limited bounds in relation to the central portion 44, whereby the unhindered moveability between the pusher rod 22 and the central portion 44 is determined by a flange 49 which extends about and radially from the pusher rod 22, and a recess 50 in the central portion 44. This unhindered moveability between the pusher rod 22 and the central portion 44 which is specified in an axial direction, is determined by the configuration of the latching crown 26 and the recesses 30 in the end surface 28 of every stabilizing fin 12. The star-shaped leaf spring 46 of the follower device 34 possesses resilient strips 52 which extend away from the collar 48, whereby the number of the resilient strips 52 corresponds with the number of the stabilizing fins 12 of the projectile 10. The projectile 10 can possess any suitable number of stabilizing fins 12. The resilient strips 52 are constructed in concavely curved shape and, in the inoperative position of the projectile 10 as shown in FIG. 1, contact against the camming or runoff edge 36 of each stabilizing fin 12. From FIGS. 1 through 4 there can be ascertained that the camming edge 36 of each stabilizing fin 12 is constructed in a convexly curved configuration.

Figure 6:
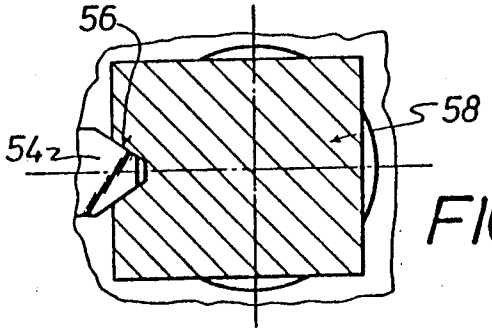
FIG. 6 illustrates, on an enlarged scale, a sectional view taken along line VI—VI in FIG. 1.

The free end section 54 of each resilient strip 52 of the star-shaped leaf spring 46 which is distant from the collar 48, in the inoperative position of the stabilizing fins 12 as is illustrated in FIG. 1, extends into an associated recess 54 formed in a respective fin shaft 58. From FIG. 6 there can be ascertained that the free end section 54 of the or of each of the resilient strips 52 of the star-shaped leaf spring 46 is configured in a narrowing shape, and that the therewith associated respective recess 56 is configured correspondingly narrowing so as to provide a form-fit between these elements. From FIGS. 1 through 4 there can also be ascertained that the central space 60 which is located between the fin shafts 58 is optimally utilized so that, overall, there is obtained a compact construction. With the aid of the fin shafts 58 it is possible to set the stabilizing fins 12 in any desired manner, when with the aid of the follower device 34 or, in essence, through the moving out of the end section 54 of each of the resilient strips 52 of the star-shaped leaf spring 46 from the respective recesses 56 in the fin shafts 58, the latter become freely rotatable.

The power element 20 is formed with a frusto-conically narrowing central recess 62, in which there is fastened the rearward end section 52 of the pusher rod 22. In order to maintain the surface pressure as low as possible in this location, the pusher rod 22 is formed in a narrowing shape in the same manner as the central recess 62 of the power element 20. The power element 20 which; for example, may pertain to a pyrotechnic power element, from which there extends a connecting line 64, is arranged on the airborne body 10 so as to be loosenable with the aid of a coupling nut 66 and adjustably positionable in the circumferential direction of the projectile 10 as desired. Through the arrangement of the power element 20 at the rearward end of the projectile 10 it is possible, in an advantageous manner, to mount the power element 20 in case of need in a simple and time-saving manner. As a result thereof, for instance, it is also possible at a specified time to insert the power element 20 into an otherwise inert part or subsystem in order to allow for a safe transport of the projectile 10.

Figure 2:
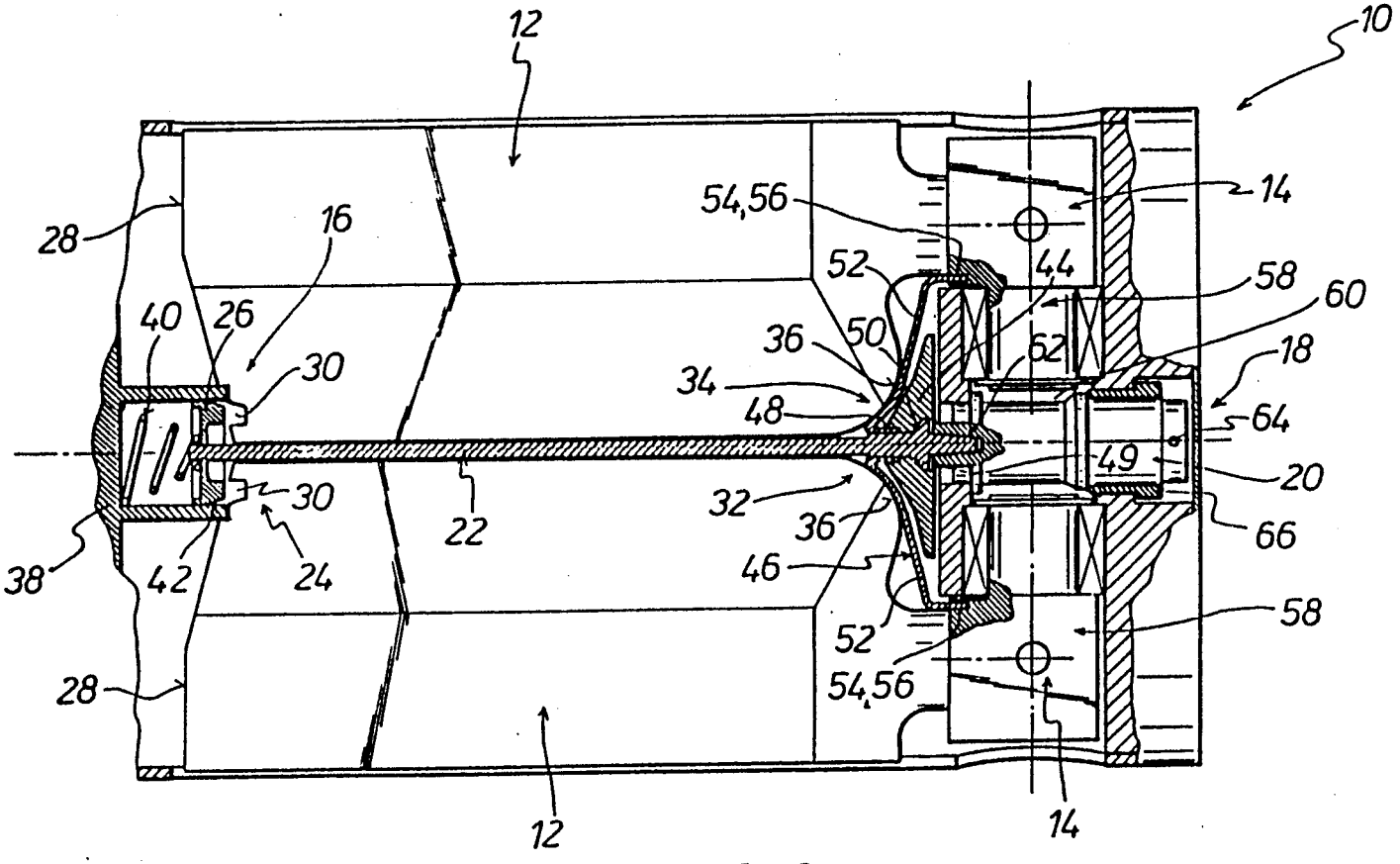
FIG. 2 illustrates a representation of the partially shown projectile similar to FIG. 1, represented in a first interim position, in which, the stabilizing fins have been unlatched through activation of the power element, while the fin shafts which are associated with the stabilizing fins are still latched.

In FIGS. 1 through 4, the same detailed components are each identified by the same reference numerals, so as to obviate the need to again describe these in detail in connection with all of the details already illustrated in FIGS. 2 through 4, as has been described hereinabove with reference to FIG. 1. The representation pursuant to FIG. 2 distinguishes itself from the operating position shown in FIG. 1 in that the latching crown 26 with the aid of the pusher rod 22 by means of the driving device 18; in essence, the power element 20, has been moved axially out of the recesses 30 formed in the end surface 28 of each of the stabilizing fins, so that the stabilizing fins 18 are now unlatched, while the fin shafts 58 which are associated with the individual stabilizing fins 12 are still latched by means of the free end sections 58 of the resilient strips 52 of the star-shaped leaf spring 46.

FIG. 3 illustrates a second interim position of the projectile 10 which is successive in time with the first interim position shown in FIG. 2, wherein the free end sections 54 of the resilient strips 52 of the star-shaped leaf springs 46 have now been moved out of the recesses 56 in the fin shafts 58 so that the fin shafts 58 are unlatched. Simultaneously, with the aid of the follower device 34 there commences the outward extending movement of the stabilizing fins 12 from the projectile 10. In FIG. 4, the stabilizing fins 12 are paritally illustrated int he operative position in which they extend from the projectile 10, whereby the fin shafts 58 of the stabilizing fins 12 are rotatable.

Figure 7:
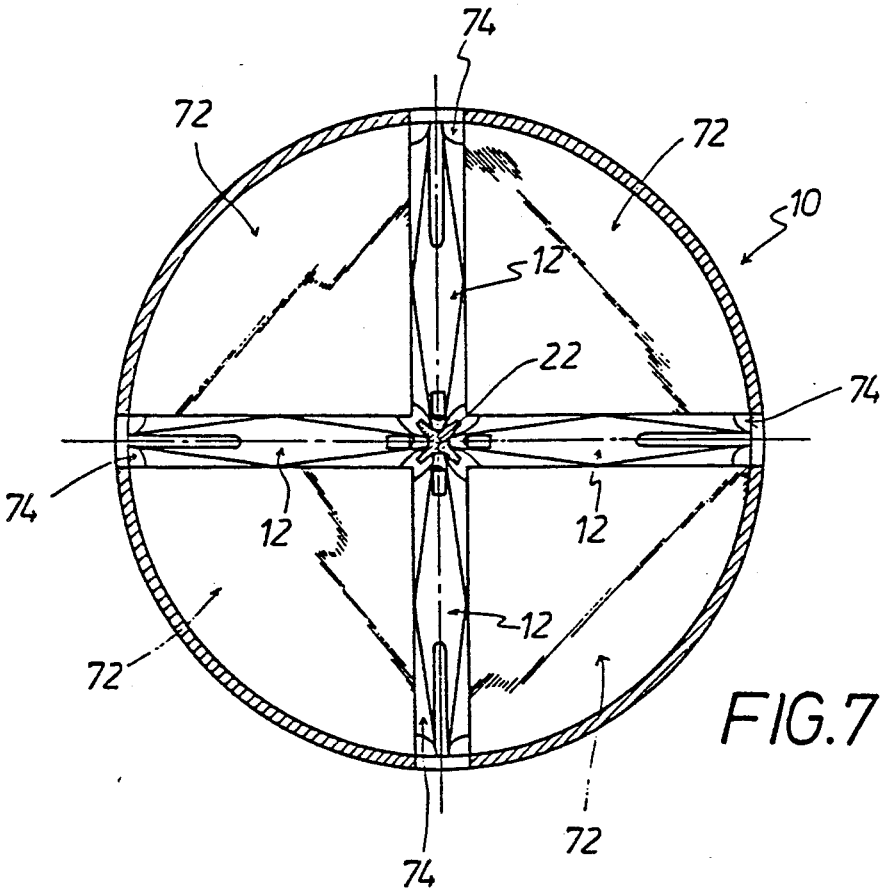
FIG. 7 illustrates a transverse sectional view through an embodiment of the projectile, shown in the inoperative position of the stabilizing fins.

FIG. 7 illustrates in a cross-sectional view a projectile 10 with installed components 72 and with four stabilizing fins 12 in their retracted inoperative position, whereby from this figure there can be particularly clearly ascertained the cross-sectional profile of the pusher rod 22. Through that type of configuration for the pusher rod 22 with a cruciform cross-sectional profile, there is afforded an optimum degree of buckling strength to the pusher rod 22. Moreover, through such a configuration there is provided the capability that the stabilizing fins 12, in their retracted inoperative position, can contact against the pusher rod 22, as a result of which there is avoided any unintended buckling of the pusher rod 22.

Figure 8:
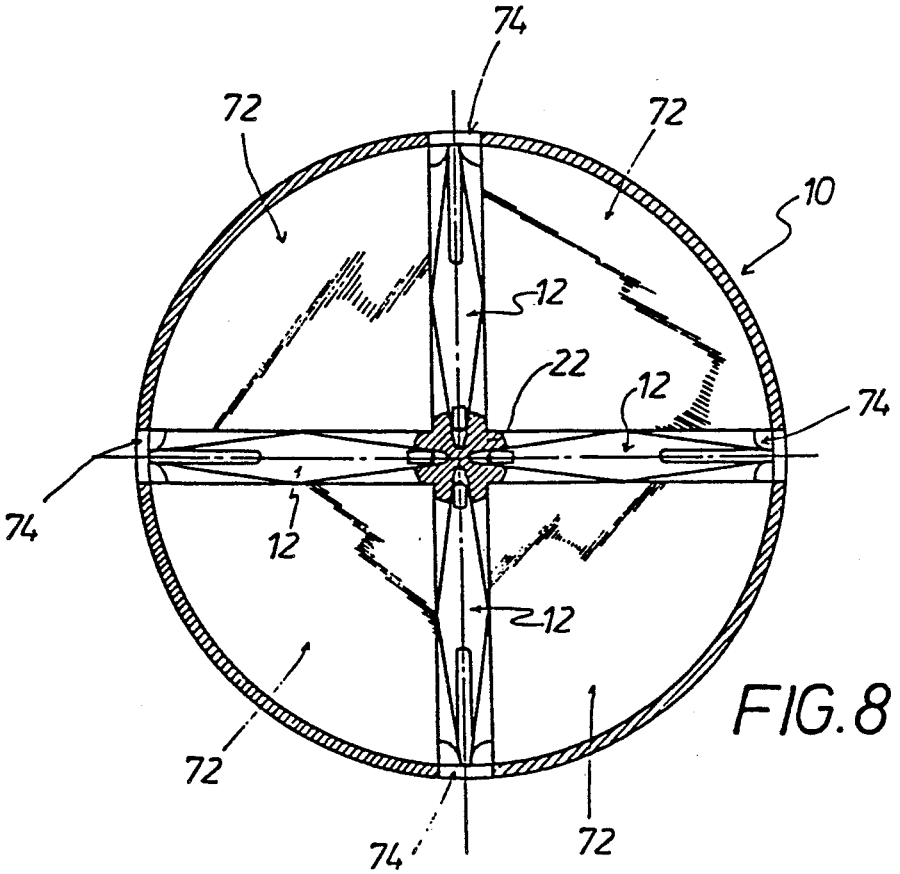
FIG. 8 illustrates a sectional view, similar to FIG. 7, through a second embodiment of the projectile which differs from the embodiment illustrated in FIG. 7 primarily through a different configuration of the pusher rod.

Since for a construction of a pusher rod 22 pursuant to FIG. 7 there is not completely avoidable any cross-current air flow through the slits 74 for the fins, in order to avoid that kind of cross-current flow, it is expedient when the pusher rod 22 is formed with a cross-section as shown in FIG. 8. Reference numeral 12, as also illustrated in FIG. 8, identifies each of the stabilizing fins of the projectile 10 in its retracted inoperative position.

What is claimed is:

1. Arrangement for effectuating the unlatching and the extension of stabilizing fins of a projectile, including a power element of a driving device operative in the longitudinal axial direction of the projectile; follower means operatively connected to said power element; camming edges located on said stabilizing fins, said power element pressing said follower means against said camming edges upon the release of a latch for the stabilizing fins in the region of free end surfaces of said fins; said latch including a latching crown engaging said free end surfaces of said fins; a spring normally biasing said latching crown towards said end surfaces; and a pusher rod having a longitudinal displacement imparted thereto by said power element to raise said latching crown away from said and surfaces in opposition to the biasing force of said spring prior to said pusher rod extending past said follower means for pressing against said camming edges.

2. Arrangement as claimed in claim 1, wherein said follower means has a central portion displaceable on the pusher rod, said central portion contacting a flange on said pusher rod for limiting the displacement of said follower means, each said camming edge being convexly-curved, said follower means including a concavely extending partial section located behind the convexly-curved camming edge.

3. Arrangement as claimed in claim 1, wherein said spring for biasing said latching crown is located between the latching crown and a fixed section on the projectile, said spring counteracting the power element acting on the pusher rod.

4. Arrangement as claimed in claim 3, wherein said spring comprises a frusto-conically narrowing helical compression spring.

5. Arrangement as claimed in claim 1, wherein said latching crown includes wedge-shaped casing surface sections which narrow towards the power element of the driving device, said stabilizing fins each include a recess for the latching crown at the end surface of each said stabilizing fin distant from a bearing means for said fins, each recess having a profile correlated with the cross-sectional profile of the respective associated surface section of the latching crown.

6. Arrangement as claimed in claim 1, wherein the latching crown has an end section thereof distant from the driving device provided with a cambered outer casing surface.

7. Arrangement as claimed in claim 1, wherein said follower means includes a star-shaped leaf spring in front of a central portion through which the pusher rod movably extends within specified bounds, said star-shaped leaf spring including a plurality of resilient strips in conformance with the number of stabilizing fins which, in the inoperative position of the stabilizing fins, contact the camming edges of an associated stabilizing fin.

8. Arrangement as claimed in claim 7, wherein each resilient strip, in the inoperative position of the stabilizing fins, contacts with a concavely curved portion formed on a camming edge of an associated stabilizing fin.

9. Arrangement as claimed in claim 8, wherein each stabilizing fin includes a fin shaft for the guidance of the projectile, each said resilient strip of the star-shaped leaf spring of the follower device having the end section thereof which is distant from the central portion extending into an associated recess formed in an associated fin shaft.

10. Arrangement as claimed in claim 9, wherein the end section of each said resilient strip of the star-shaped leaf spring and the therewith associated recess in every fin shaft are constructed with reducing cross-sectional configurations.

11. Arrangement as claimed in claim 1, wherein the power element includes a frusto-conically narrowing recess and the end section of the pusher rod which is supported by the power element is configured in a frusto-conically narrowing configuration in conformance with said recess.

12. Arrangement as claimed in claim 1, wherein the pusher rod is constructed with a cross-sectional profile for inhibiting a cross-current air flow through said stabilizing fins.

13. Arrangement as claimed in claim 1, wherein the power element is mounted at the trailing end section of said projectile so as to be adjustable along the circumferential direction of said projectile.

14. Arrangement as claimed in claim 1, wherein the power element is detachably mounted on the projectile.

15. Arrangement as claimed in claim 1, wherein said power element comprises a pyrotechnic power element.

* * * * *